US009384873B2

(12) United States Patent
Yonezawa et al.

(10) Patent No.: US 9,384,873 B2
(45) Date of Patent: Jul. 5, 2016

(54) DIFFERENTIAL SIGNAL TRANSMISSION CABLE

(71) Applicant: Hitachi Metals, Ltd., Tokyo (JP)

(72) Inventors: Hidenori Yonezawa, Hitachi (JP); Takahiro Sugiyama, Hitachi (JP); Hideki Nonen, Mito (JP); Izumi Fukasaku, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 14/459,205

(22) Filed: Aug. 13, 2014

(65) Prior Publication Data

US 2015/0053453 A1 Feb. 26, 2015

(30) Foreign Application Priority Data

Aug. 22, 2013 (JP) ..... 2013-172182

(51) Int. Cl.
*H01B 7/00* (2006.01)
*H01B 11/00* (2006.01)

(52) U.S. Cl.
CPC ..... *H01B 11/002* (2013.01)

(58) Field of Classification Search
USPC ..... 174/110 R, 113 R, 113 C, 115, 116
See application file for complete search history.

(56) References Cited

U.S. PATENT DOCUMENTS 3,474,186 A * 10/1969 Hale ..... H01B 9/023 174/103
3,582,532 A * 6/1971 Plummer ..... H02G 3/0487 174/102 R
3,757,029 A * 9/1973 Marshall ..... H01B 7/08 174/117 F
4,319,075 A * 3/1982 Willette ..... H02G 1/00 174/117 FF
4,323,721 A * 4/1982 Kincaid ..... H01B 11/06 174/103
4,327,246 A * 4/1982 Kincaid ..... H01B 11/1025 174/105 R
4,477,693 A * 10/1984 Krabec ..... H01B 11/1016 174/105 R
4,652,772 A * 3/1987 Shephard ..... H01B 7/0838 174/117 F
4,855,534 A * 8/1989 O'Connor ..... H01B 11/1016 156/202

(Continued)

FOREIGN PATENT DOCUMENTS

JP 2011-86458 A 4/2011
JP 2011-96574 A 5/2011
JP 2012-169251 A 9/2012
WO WO2006/031633 A1 * 3/2006 ..... H01B 11/06

*Primary Examiner* — William H Mayo, III
(74) *Attorney, Agent, or Firm* — McGinn IP Law Group PLLC

(57) ABSTRACT

In a differential signal transmission cable, a surface of a skin layer is partially provided with shield conductors disposed at respective equidistant portions spaced apart in a direction orthogonal to a direction in which two signal conductors are arranged, the equidistant portions each being distant by the same distance from axial centers of the signal conductors. On the surface of the skin layer, the shield conductors are not provided in areas located in the direction in which the signal conductors are arranged, and spaces are created in these areas.

20 Claims, 6 Drawing Sheets

(56) References Cited

U.S. PATENT DOCUMENTS 5,023,395 A * 6/1991 O'Connor ..... B32B 15/08 156/202
5,053,582 A * 10/1991 Terakawa ..... H01B 11/1025 156/53
5,552,565 A * 9/1996 Cartier ..... H01B 7/0892 174/117 F
6,403,887 B1 * 6/2002 Kebabjian ..... H01B 11/002 174/110 R
6,664,466 B2 * 12/2003 Bailey ..... H01B 11/1091 174/105 R
6,740,808 B1 * 5/2004 Chang ..... H01B 7/0861 174/113 R
8,916,775 B2 * 12/2014 Tamaki ..... H01B 11/1025 174/102 R
2011/0083877 A1 4/2011 Sugiyama et al.
2011/0100682 A1 5/2011 Nonen et al.
2012/0186850 A1 7/2012 Sugiyama et al.
2012/0200268 A1 * 8/2012 Ye ..... H02M 1/4225 323/210

* cited by examiner

DIFFERENTIAL SIGNAL TRANSMISSION CABLE

The present application is based on Japanese patent application No. 2013-172182 filed on Aug. 22, 2013, the entire contents of which are incorporated herein by reference.

BACKGROUND OF THE INVENTION

1. Field of the Invention

The present invention relates to a differential signal transmission cable that includes a pair of signal conductors and transmits differential signals having a phase difference of 180 degrees.

2. Description of the Related Art

Devices (e.g., servers, routers, and storage products) dealing with high-speed digital signals of several gigabits per second (Gbit/s) or more have adopted a differential interface standard, such as the low-voltage differential signaling (LVDS). Between devices or between circuit boards within a device, differential signals are transmitted through a differential signal transmission cable. Differential signals are characterized by having a high resistance to external noise while making it possible to provide a low-voltage system power supply.

A differential signal transmission cable includes a pair of signal conductors, which are configured to transmit a plus-side signal and a minus-side signal having a phase difference of 180 degrees. A potential difference between these two signals is represented by a signal level. For example, if the potential difference is plus, a signal level "High" is detected on the receiving side, and if the potential difference is minus, a signal level "Low" is detected on the receiving side.

Examples of the differential signal transmission cable that transmits such differential signals are disclosed in Japanese Unexamined Patent Application Publication Nos. 2011-086458, 2011-096574, and 2012-169251. The differential signal transmission cables disclosed in these documents include a pair of signal conductors arranged in parallel and spaced apart by a predetermined distance. Each of the signal conductors is covered by an insulator, and the entire periphery of the insulator is covered by a sheet-like shield conductor.

In the differential signal transmission cables disclosed in the documents described above, the entire periphery of the insulator is covered by a shield conductor. As a result, for example, a manufacturing error in the differential signal transmission cable may cause variation in distance from each signal conductor to the shield conductor.

FIG. 7 is a transverse cross-sectional view of a differential signal transmission cable of the related art having a manufacturing error. Specifically, as indicated by distances "e" and "f", a differential signal transmission cable "a" has a difference in thickness dimension of an insulator "d" (i.e., a difference in distance to a shield conductor "g") in the direction in which a signal conductor "b" on the positive (P: +) side and a signal conductor "c" on the negative (N: −) side are arranged. That is, in the case of FIG. 7, the distance "e" between the signal conductor "b" on the P side and the shield conductor "g" is shorter than the distance "f" between the signal conductor "c" on the N side and the shield conductor "g" ($e<f$).

The difference in thickness dimension of the insulator "d" (i.e., the difference between the distances "e" and "f") leads to a difference in dielectric constant $\in$ and further leads to a difference in effective dielectric constant $\in ef$ between the signal conductor "b" on the P side and the signal conductor "c" on the N side. The difference in effective dielectric constant $\in ef$ between the signal conductors "b" and "c" causes a difference in propagation time between transmission signals propagating through the signal conductors "b" and "c". The effect of a so-called "skew" on transmission signals becomes more significant as the speed of the signals increases. Therefore, there has been a need to change the structure of differential signal transmission cables to support high-speed transmission signals.

SUMMARY OF THE INVENTION

An object of the present invention is to provide a differential signal transmission cable capable of reducing the occurrence of a skew and reliably supporting high-speed transmission signals.

According to one exemplary aspect of the present invention, a differential signal transmission cable includes a pair of signal conductors; an insulator disposed around each of the signal conductors; and a shield conductor provided in part of a surface of the insulator and disposed at an equidistant portion located in a direction orthogonal to a direction in which the signal conductors are arranged, the equidistant portion being equidistant from axial centers of the signal conductors.

In the above exemplary invention, many exemplary modifications and changes can be made as below.

(i) The insulator may include a first insulator disposed around the signal conductors and containing air bubbles, and a second insulator disposed around the first insulator and containing no air bubbles.

(ii) The shield conductor may be secured to the insulator with an adhesive.

(iii) An adhesive sheet for securing the shield conductor to the insulator may be provided between the insulator and the shield conductor.

(iv) The insulator may have a transverse cross-section of an elliptical shape with a major axis and a minor axis, the major axis extending in the direction in which the signal conductors are arranged and the minor axis being orthogonal to the major axis.

(v) The insulator may have a transverse cross-section of a track-like shape with a pair of linear portions and a pair of arc portions located between the linear portions, the linear portions extending in the direction in which the signal conductors are arranged.

(vi) The shield conductor may include a pair of shield conductors disposed opposite each other, with the insulator interposed therebetween, in the direction orthogonal to the direction in which the signal conductors are arranged.

(vii) The pair of shield conductors may have a width dimension greater than a distance between the axial centers of the signal conductors.

(viii) The pair of shield conductors may be devoid in the direction in which the signal conductors are arranged.

(ix) The insulator may cover the peripheries of the signal conductors together.

In the differential signal transmission cable according to the present invention, the surface of the insulator is partially provided with the shield conductor disposed at the equidistant portion located in the direction orthogonal to the direction in which the signal conductors are arranged, the equidistant portion being equidistant from the axial centers of the signal conductors. Thus, even if there is a manufacturing error which may cause misalignment of the signal conductors inside the insulating member, the distances from the respective axial centers of the signal conductors to the shield conductor can be made substantially the same.

On the surface of the insulator, the shield conductor is not provided in an area located in the direction in which the signal conductors are arranged, and a space can be created in this area. Thus, even if there is a manufacturing error which may cause misalignment of the signal conductors inside the insulator, since the dielectric constant of the space portion is small and the effective dielectric constants of the signal conductors in the direction in which they are arranged are close to the dielectric constant of the space portion, a difference in effective dielectric constant between the signal conductors can be reduced.

Therefore, it is possible to provide a differential signal transmission cable capable of reducing the occurrence of a skew and reliably supporting high-speed transmission signals.

DESCRIPTION OF THE PREFERRED EMBODIMENTS

A first embodiment of the present invention will now be described in detail with reference to the drawings.

Figure 1A:
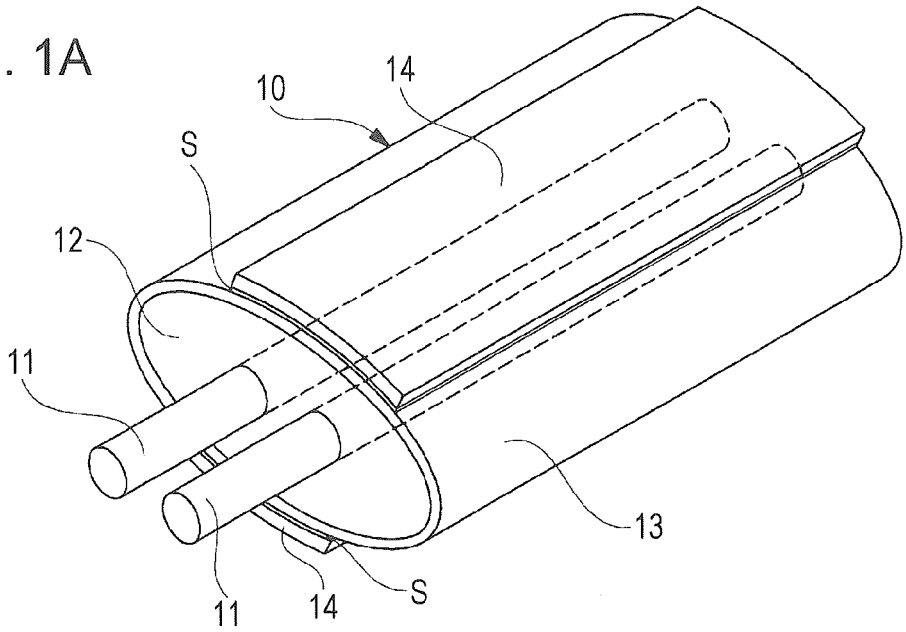
FIG. 1A is a perspective view of a differential signal transmission cable according to a first embodiment of the present invention.
Figure 1B:
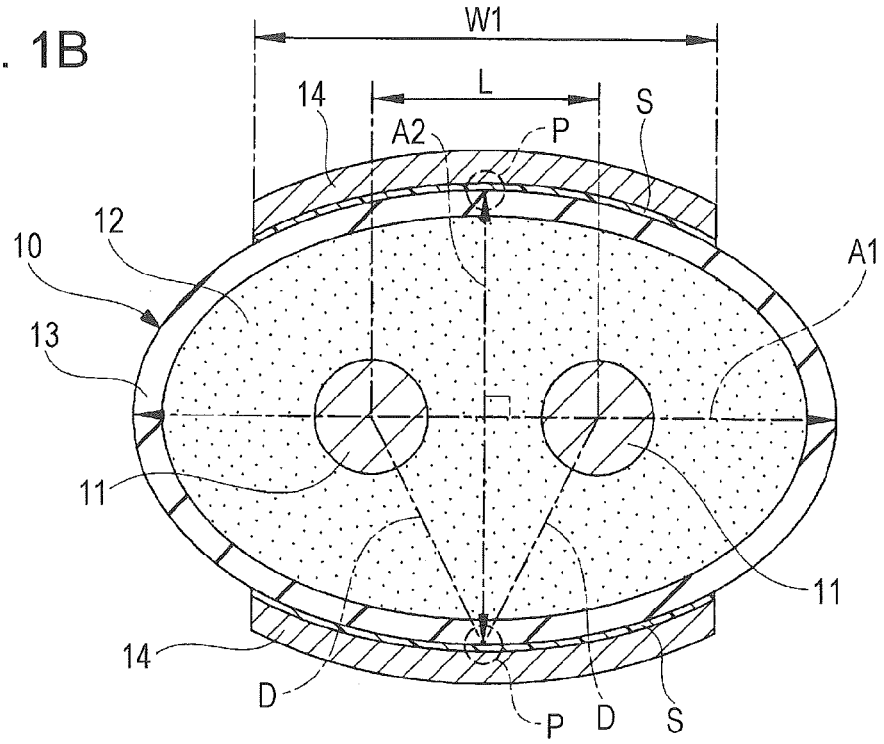
FIG. 1B is a transverse cross-sectional view of FIG. 1A.
Figure 2A:
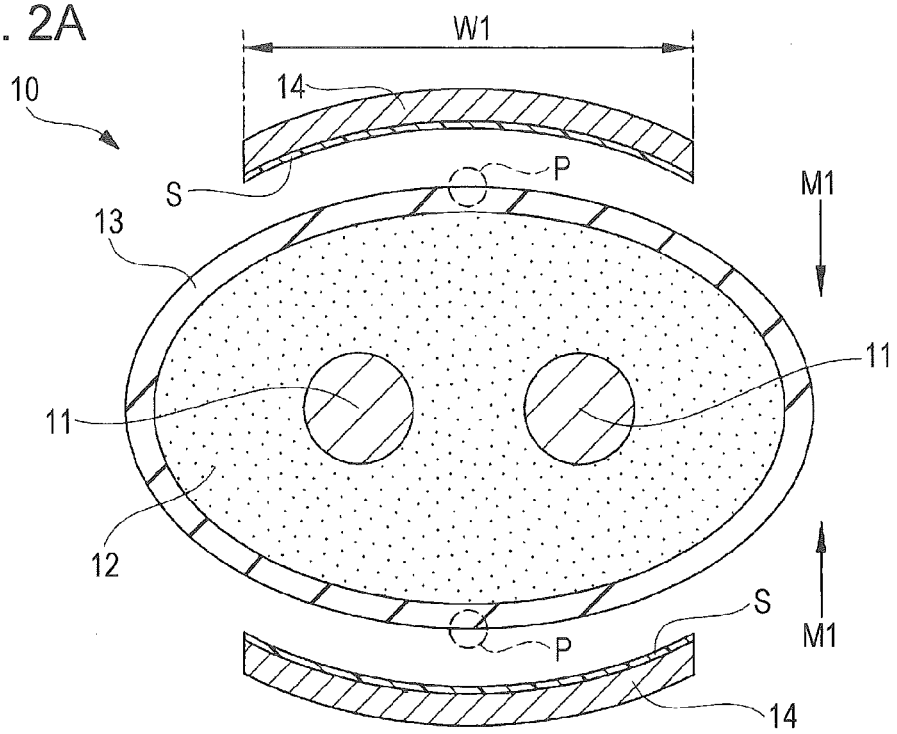
FIG. 2A is a transverse cross-sectional view illustrating how shield conductors are attached.
Figure 2B:
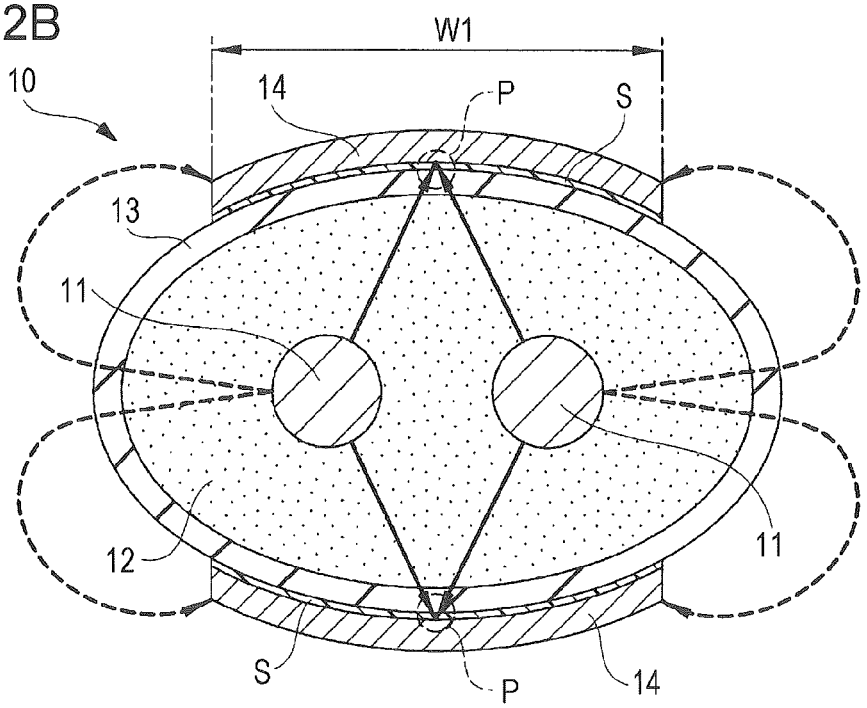
FIG. 2B is a transverse cross-sectional view schematically illustrating an electric field emanating from each signal conductor to the shield conductors.

FIG. 1A is a perspective view of a differential signal transmission cable according to the first embodiment, and FIG. 1B is a transverse cross-sectional view of FIG. 1A. FIG. 2A is a transverse cross-sectional view illustrating how shield conductors are attached, and FIG. 2B is a transverse cross-sectional view schematically illustrating an electric field emanating from each signal conductor to the shield conductors.

As illustrated in FIGS. 1A and 1B, a differential signal transmission cable 10 of the first embodiment includes a pair of signal conductors 11. A plus-side signal (positive: +) serving as a differential signal is transmitted through one of the signal conductors 11, and a minus-side signal (negative: −) serving as the other differential signal is transmitted through the other of the signal conductors 11. Each signal conductor 11 is formed, for example, by a silver-plated copper wire. This makes the differential signal transmission cable 10 suitable for high-speed transmission. Alternatively, for example, an inexpensive tinned-annealed copper wire may be used as the signal conductor 11 where appropriate.

The peripheries of the signal conductors 11 are covered together by a common insulating member (insulator) 12. To reduce high-frequency losses in the differential signal transmission cable 10, the insulating member 12 is made, for example, of foamed polyethylene containing air bubbles. The insulating member 12 has a low dielectric constant $\in 1$ because it contains air bubbles.

The periphery of the insulating member 12 is covered by a skin layer (insulator) 13 made, for example, of polyethylene containing no air bubbles. The skin layer 13, which contains no air bubbles, is set to have a higher stiffness than the insulating member 12. By the skin layer 13, the insulating member 12 which is soft and has not been hardened during its extrusion molding can be kept in a predetermined elliptical shape. Since the skin layer 13 contains no air bubbles, a dielectric constant $\in 2$ of the skin layer 13 is higher than the dielectric constant $\in 1$ of the insulating member 12 ($\in 2 > \in 1$).

The insulating member 12 corresponds to a first insulator in the present invention, and the skin layer 13 corresponds to a second insulator in the present invention. That is, the insulating member 12 is disposed around the signal conductors 11, and the skin layer 13 is disposed around the insulating member 12. The skin layer 13 has a thickness dimension which is substantially uniform in the circumferential direction. The transverse cross-section of the skin layer 13 including the insulating member 12 has an elliptical shape with a major axis A1 and a minor axis A2. The major axis A1 extends in the direction in which the signal conductors 11 are arranged (this direction may hereinafter be referred to as the direction of arrangement of the signal conductors 11), and the minor axis A2 is orthogonal to the major axis A1.

The surface of the skin layer 13 is partially provided with a pair of shield conductors 14 serving as ground conductors for the signal conductors 11. The shield conductors 14 are disposed opposite each other, with the skin layer 13 interposed therebetween, in the direction of the minor axis A2. The shield conductors 14 extend straight in the longitudinal direction of the signal conductors 11.

Each of the shield conductors 14 is formed, for example, by a sheet of copper foil and its width dimension W1 is set to be greater than a distance L between the axial centers of the signal conductors 11 (W1>L). Each shield conductor 14 may be made of another metal foil, instead of copper foil, or may be a braided wire formed by braiding thin metal wires, such as annealed copper wires.

The same amount of adhesive S is applied to the same thickness to both the shield conductors 14, so that each shield conductor 14 is tightly secured to the skin layer 13. The adhesive S may be, for example, a polyester adhesive.

An intermediate portion of each shield conductor 14 in the width direction thereof, that is, a position corresponding to half the width dimension W1 of the shield conductor 14 (i.e., the position corresponding to W1/2) is located at an equidistant portion P on the surface of the skin layer 13. There are two equidistant portions P on the surface of the skin layer 13, that is, at both ends of the minor axis A2. The equidistant portions P are spaced apart in the direction orthogonal to the direction of arrangement of the signal conductors 11. Each equidistant portion P is distant by the same distance D from the axial centers of the signal conductors 11. That is, each shield conductor 14 covers the corresponding equidistant portion P of the skin layer 13 at substantially the center in the width direction.

As described above, the width dimension W1 of each shield conductor 14 is set to be greater than the distance L between the axial centers of the signal conductors 11, and the sealing portion 14 covers the corresponding equidistant portion P. Therefore, even if the signal conductors 11 become misaligned inside the insulating member 12 and the misalignment causes misalignment (manufacturing error) of the equidistant portions P, the shield conductors 14 can reliably cover the respective equidistant portions P.

On the surface of the skin layer 13, the shield conductors 14 are not provided in areas located in the direction of arrangement of the signal conductors 11 (on both the right and left sides in FIG. 1B), and spaces are created in these areas. A dielectric constant $\in a$ of air is smaller than the dielectric constant $\in 1$ of the insulating member 12 and the dielectric constant $\in 2$ of the skin layer 13 ($\in a<\in 1<\in 2$).

Although the peripheries of the shield conductors 14 are not surrounded by anything, an insulating layer (not shown) serving as a protective outer sheath may be provided to protect the skin layer 13 and the shield conductors 14. For example, the insulating layer may be formed by winding insulating tape or by extruding an insulating material around the skin layer 13 and the shield conductors 14. Considering all possible environments where the differential signal transmission cable 10 will be used, it is desirable to select heat-resistant polyvinyl chloride (PVC) as the material of the insulating layer.

To secure the shield conductors 14 to the surface of the skin layer 13 as illustrated in FIG. 2A, the same amount of adhesive S is applied to the same thickness to the surfaces (bonding surfaces) of the shield conductors 14 adjacent to the skin layer 13. This can prevent electrical characteristics from being deteriorated by a difference in thickness of the adhesive S between the shield conductors 14. Then, as indicated by arrow M1 in FIG. 2A, each shield conductor 14 is positioned to face the corresponding equidistant portion P on the surface of the skin layer 13 at the position corresponding to half the width dimension W1 of the shield conductor 14. The shield conductor 14 is thus secured to a predetermined location of the skin layer 13. Caution is required to prevent creation of air space (accumulation of air) between the skin layer 13 and each shield conductor 14.

As indicated by solid arrows in FIG. 2B, electric fields emanating from both the signal conductors 11 to the shield conductors 14 pass through substantially equivalent portions of the insulating member 12 and the skin layer 13. Therefore, it is unlikely that there is a difference in effective dielectric constant $\in ef$ between the signal conductors 11. Also as indicated by broken arrows in FIG. 2B, electric fields emanating from the signal conductors 11 in opposite directions along the direction of arrangement of the signal conductors 11 propagate around the insulating member 12, the skin layer 13, and space to reach the shield conductors 14. Therefore, even if, for example, the signal conductors 11 become misaligned inside the insulating member 12 or there is an error in thickness of the skin layer 13 on either the right or left side in FIG. 2B, since the dielectric constant $\in a$ of air is small and the paths indicated by broken arrows (detour paths of electric field lines) are long, the effective dielectric constants $\in ef$ of the signal conductors 11 in the direction of arrangement are close to the dielectric constant $\in a$ of the space portions and a difference in effective dielectric constant $\in ef$ between the signal conductors 11 can be reduced.

As described above in detail, in the differential signal transmission cable 10 of the first embodiment, the surface of the skin layer 13 is partially provided with the shield conductors 14 disposed at the respective equidistant portions P spaced apart in the direction orthogonal to the direction of arrangement of the signal conductors 11. Each of the equidistant portions P is distant by the same distance D from the axial centers of the signal conductors 11. Thus, even if there is a manufacturing error which may cause misalignment of the signal conductors 11 inside the insulating member 12, the distances D from the respective axial centers of the signal conductors 11 to each shield conductor 14 can be made substantially the same.

On the surface of the skin layer 13, the shield conductors 14 are not provided in the areas located in the direction of arrangement of the pair of signal conductors 11, and spaces are created in these areas. Thus, even if there is a manufacturing error which may cause misalignment of the signal conductors 11 inside the insulating member 12, since the dielectric constant $\in a$ of the space portions is small and the effective dielectric constants $\in ef$ of the signal conductors 11 in the direction of arrangement are close to the dielectric constant $\in a$ of the space portions, a difference in effective dielectric constant $\in ef$ between the signal conductors 11 can be reduced.

Therefore, it is possible to provide the differential signal transmission cable 10 capable of reducing the occurrence of a skew and reliably supporting high-speed transmission signals.

A second embodiment of the present invention will now be described in detail with reference to the drawings. Parts having the same functions as those in the first embodiment are given the same symbols and their detailed description will be omitted.

Figure 3A:
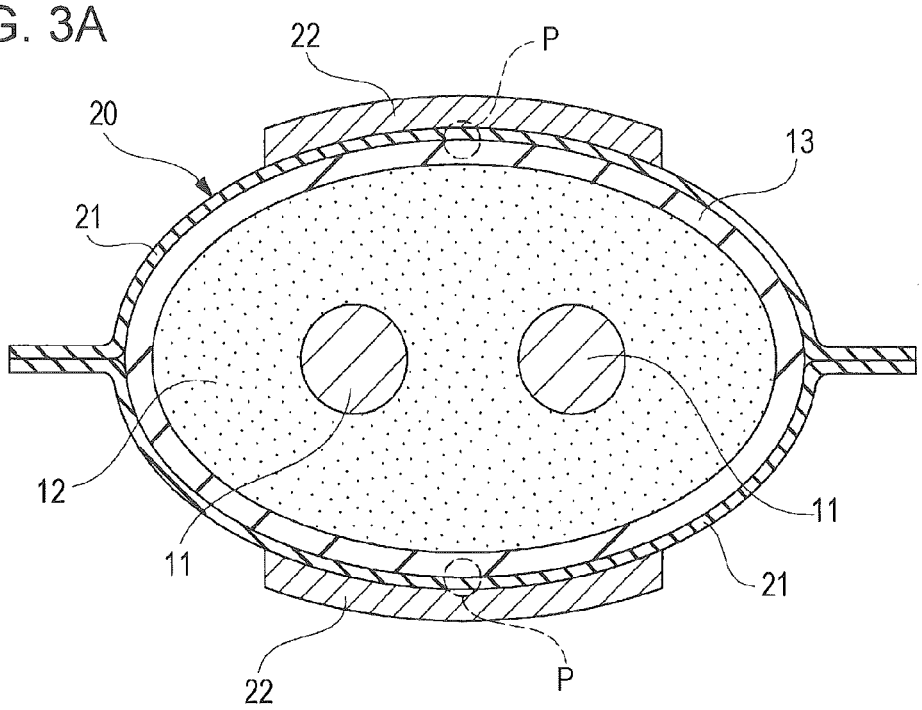
FIG. 3A is a transverse cross-sectional view of a differential signal transmission cable according to a second embodiment of the present invention.
Figure 3B:
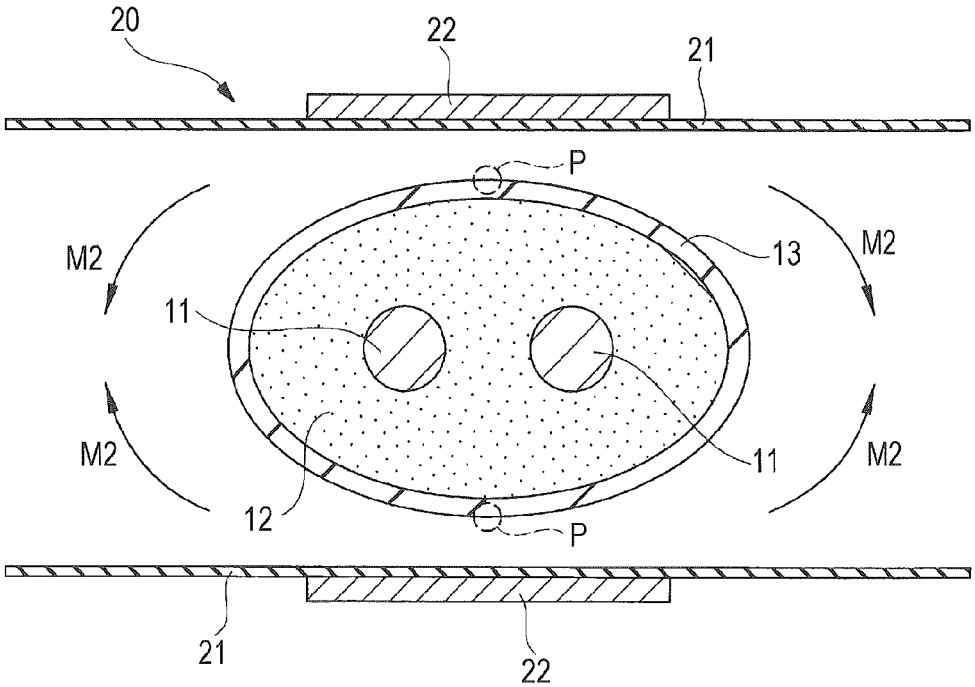
FIG. 3B is a transverse cross-sectional view illustrating how shield conductors in FIG. 3A are mounted.

FIG. 3A is a transverse cross-sectional view of a differential signal transmission cable according to the second embodiment, and FIG. 3B is a transverse cross-sectional view illustrating how shield conductors in FIG. 3A are mounted.

As illustrated in FIG. 3A, in a differential signal transmission cable 20 of the second embodiment, each shield conductor 22 is secured to the surface of the skin layer 13, with polyester tape (hereinafter, PET tape) 21 serving as an insulator and adhesive sheet. That is, the PET tape 21 is interposed between the skin layer 13 and each shield conductor 22. The shield conductor 22 is secured to the PET tape 21 in advance. This facilitates positioning of each shield conductor 22 with respect to the skin layer 13. That is, when the PET tape 21 having a larger surface area than the shield conductor 22 is positioned with respect to the skin layer 13 and attached thereto as indicated by arrows M2 in FIG. 3B, the shield conductor 22 automatically covers the equidistant portion P. In the second embodiment, caution is required again to prevent creation of air space between the skin layer 13 and the PET tape 21.

In the second embodiment configured as described above, the same function effects as those of the first embodiment can be achieved. Since the skin layer 13 is covered with the PET tape 21, it is possible to enhance the strength of the differential signal transmission cable 20 without providing any insulating layer for protection purposes.

A third embodiment of the present invention will now be described in detail with reference to the drawings. Parts having the same functions as those in the first embodiment are given the same symbols and their detailed description will be omitted.

Figure 4A:
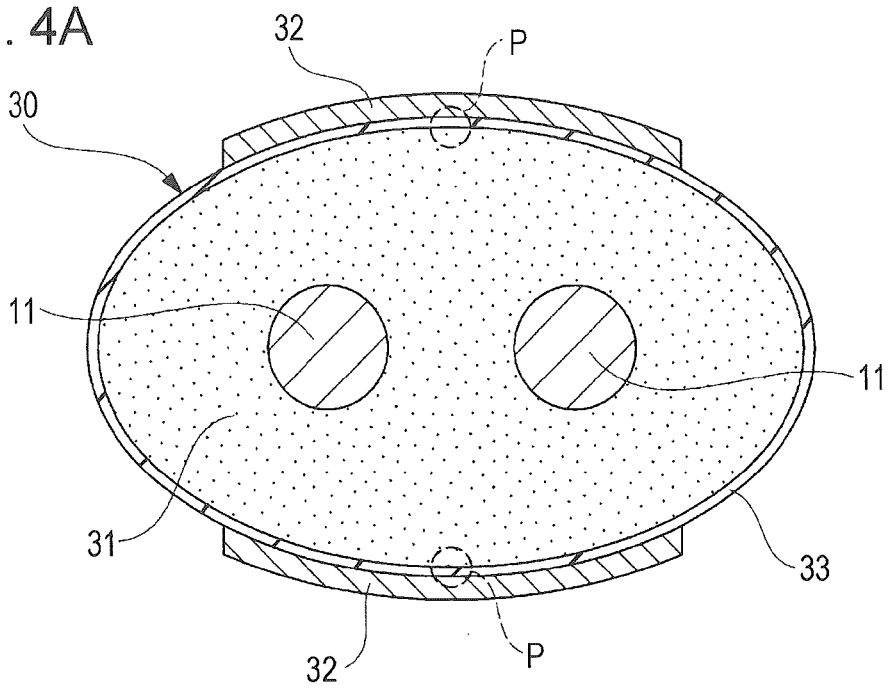
FIG. 4A is a transverse cross-sectional view of a differential signal transmission cable according to a third embodiment of the present invention.
Figure 4B:
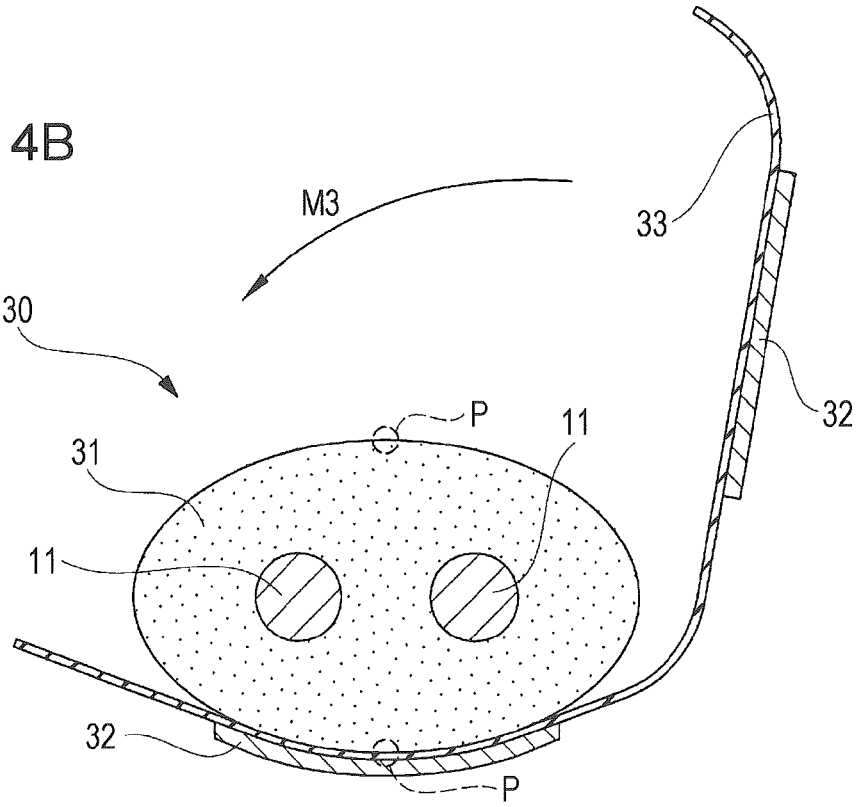
FIG. 4B is a transverse cross-sectional view illustrating how shield conductors in FIG. 4A are mounted.

FIG. 4A is a transverse cross-sectional view of a differential signal transmission cable according to the third embodiment, and FIG. 4B is a transverse cross-sectional view illustrating how shield conductors in FIG. 4A are mounted.

Unlike the differential signal transmission cable 10 of the first embodiment, a differential signal transmission cable 30 of the third embodiment illustrated in FIGS. 4A and 4B has no skin layer 13 (see FIGS. 1A and 1B) and has an insulating member (insulator) 31 made of solid polyethylene containing no air bubbles. A pair of shield conductors 32 is secured by winding a sheet of PET tape 33, which serves as an insulator and adhesive sheet, around the insulating member 31 and attaching the PET tape 33 to the insulating member 31. That is, the PET tape 33 is interposed between the insulating member 31 and each shield conductor 32. The shield conductors 32, spaced apart by a predetermined distance, are secured to the PET tape 33 in advance. With one shield conductor 32 (on the lower side in FIG. 4B) positioned at a predetermined position of the skin layer 13, the PET tape 33 is wound around the insulating member 31 as indicated by arrow M3 in FIG. 4B. This allows the other shield conductor 32 to be automatically positioned at a predetermined position (on the upper side in FIG. 4B) of the skin layer 13.

In the third embodiment configured as described above, the same function effects as those of the first embodiment can be achieved. Additionally, since manufacture of the differential signal transmission cable 30 is completed simply by winding a single turn of the PET tape 33 and no skin layer 13 is provided, it is possible to simplify the process of manufacture and reduce the cost of manufacturing the differential signal transmission cable 30. In both the first and second embodiments, the skin layer 13 may be omitted and an insulating member containing no air bubbles may be used, as in the third embodiment.

A fourth embodiment of the present invention will now be described in detail with reference to the drawings. Parts having the same functions as those in the first embodiment are given the same symbols and their detailed description will be omitted.

Figure 5A:
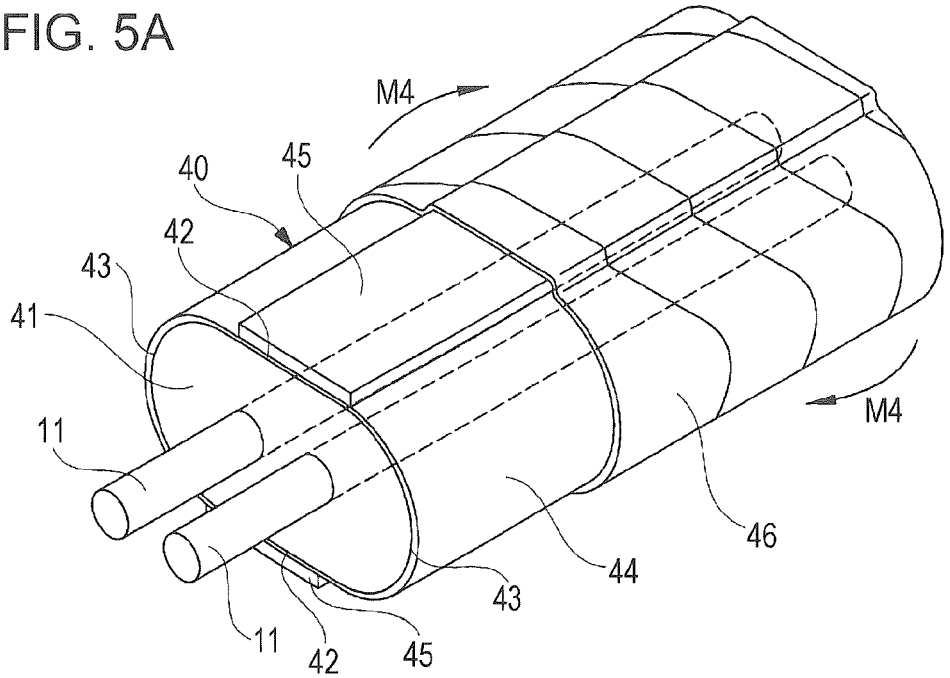
FIG. 5A is a perspective view of a differential signal transmission cable according to a fourth embodiment of the present invention.
Figure 5B:
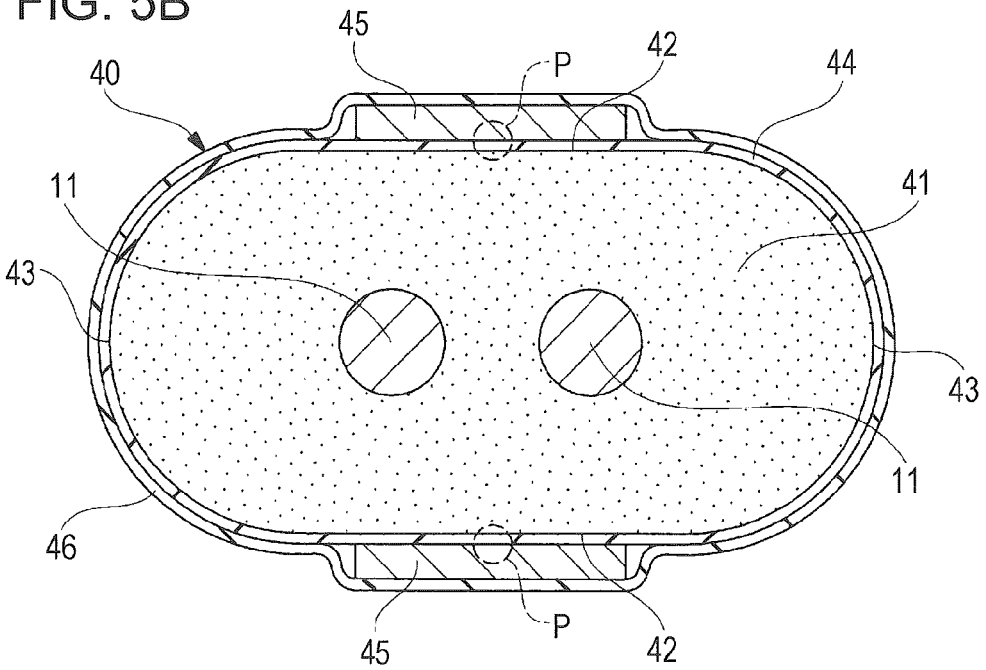
FIG. 5B is a transverse cross-sectional view of FIG. 5A.

FIG. 5A is a perspective view of a differential signal transmission cable according to the fourth embodiment, and FIG. 5B is a transverse cross-sectional view of FIG. 5A.

As illustrated in FIGS. 5A and 5B, in a differential signal transmission cable 40 of the fourth embodiment, a transverse cross-section of an insulating member (insulator or first insulator) 41 has a track-like shape which is substantially the same as a track of an athletic field. Specifically, the transverse cross-section of the insulating member 41 has a pair of linear portions 42 of equal length extending in the direction of arrangement of the signal conductors 11 and a pair of arc portions 43 located between the linear portions 42. A transverse cross-section of a skin layer (insulator or second insulator) 44 has a track-like shape that follows the shape of the transverse cross-section of the insulating member 41.

A pair of shield conductors 45 is placed directly on the respective linear portions 42 without any adhesive or adhesive sheet therebetween. Insulating tape 46 serving as an insulating layer is wound around the skin layer 44 as indicated by arrows M4 in FIG. 5A, with the shield conductors 45 placed on the respective linear portions 42. Thus, the shield conductors 45 are secured at predetermined positions of the skin layer 44.

In the fourth embodiment configured as described above, the same function effects as those of the first embodiment can be achieved. As in the third embodiment, the skin layer 44 may be omitted and an insulating member containing no air bubbles may be used in the fourth embodiment.

A fifth embodiment of the present invention will now be described in detail with reference to the drawings. Parts having the same functions as those in the first embodiment are given the same symbols and their detailed description will be omitted.

Figure 6:
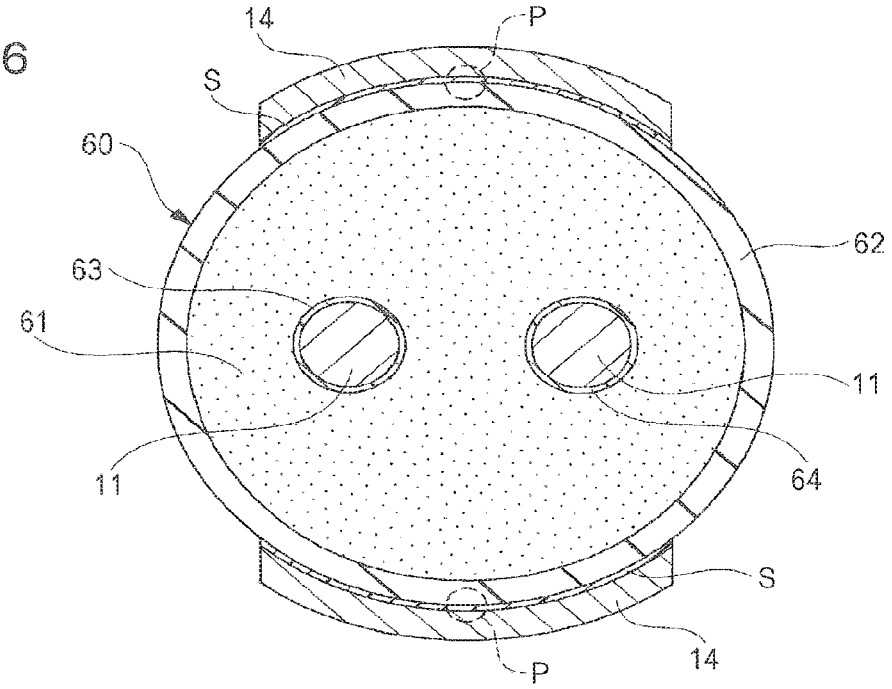
FIG. 6 is a transverse cross-sectional view of a differential signal transmission cable according to a fifth embodiment of the present invention.
Figure 7:
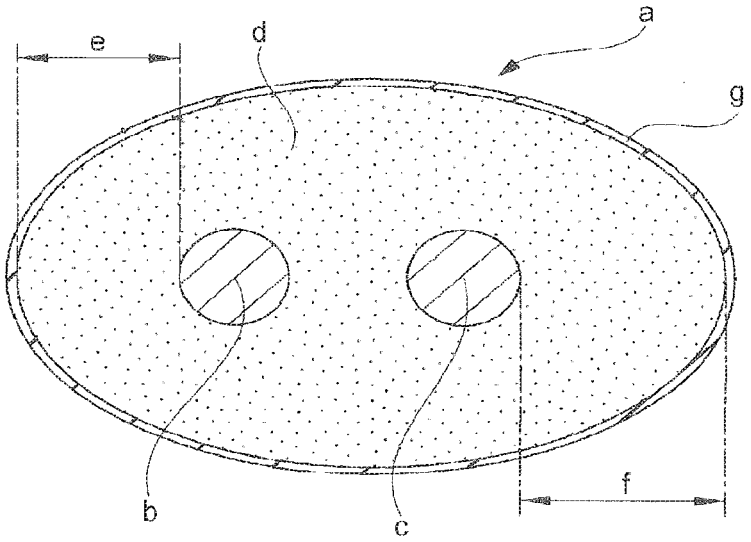
FIG. 7 RELATED ART
FIG. 7 is a transverse cross-sectional view of a differential signal transmission cable of the related art having a manufacturing error.

FIG. 6 is a transverse cross-sectional view of a differential signal transmission cable according to the fifth embodiment.

As illustrated in FIG. 6, in a differential signal transmission cable 60 of the fifth embodiment, an insulating member (insulator or first insulator) 61 and a skin layer (insulator or second insulator) 62 have a circular transverse cross-section. The insulating member 61 is made of foamed polyethylene containing air bubbles. The peripheries of the signal conductors 11 are provided with respective skin layers 63 and 64. For example, this prevents the periphery of each signal conductor 11 from being damaged when the signal conductors 11 are handled individually.

In the fifth embodiment configured as described above, the same function effects as those of the first embodiment can be achieved. In the fifth embodiment, again, the insulating member 61 may be made of polyethylene containing no air bubbles. The skin layer 62 may be omitted in this case.

The present invention is not limited to the embodiments described above, and it is obvious that various changes may be made to the present invention without departing from the scope of the present invention. For example, although the embodiments described above illustrate the configuration where each signal conductor 11 is silver-plated, the present invention is not limited to this and non-plated signal conductors may be used instead. In this case, the cost of manufacturing the differential signal transmission cables 10, 20, 30, 40, and 60 can be reduced.

What is claimed is:

1. A differential signal transmission cable comprising:

a pair of signal conductors;

an insulator disposed around each of the signal conductors; and a shield conductor provided in part of a surface of the insulator and disposed at an equidistant portion located in a direction orthogonal to a direction in which the signal conductors are arranged, the equidistant portion being equidistant from axial centers of the signal conductors, wherein the shield conductor includes a pair of shield conductors disposed opposite each other, with the insulator interposed therebetween, in the direction orthogonal to the direction in which the signal conductors are arranged, and wherein each of the shield conductors is secured to the insulator.

2. The differential signal transmission cable according to claim 1, wherein the shield conductor is secured to the insulator with an adhesive.

3. The differential signal transmission cable according to claim 1, further comprising:

an adhesive sheet configured to secure the shield conductor to the insulator.

4. The differential signal transmission cable according to claim 1, wherein the insulator has a transverse cross-section of an elliptical shape with a major axis and a minor axis, the major axis extending in the direction in which the signal conductors are arranged and the minor axis being orthogonal to the major axis.

5. The differential signal transmission cable according to claim 1, wherein the insulator has a transverse cross-section of a track-like shape with a pair of linear portions and a pair of arc portions located between the linear portions, the linear portions extending in the direction in which the signal conductors are arranged.

6. The differential signal transmission cable according to claim 1, wherein the pair of shield conductors has a width dimension greater than a distance between the axial centers of the signal conductors.

7. The differential signal transmission cable according to claim 6, wherein the pair of shield conductors is devoid in the direction in which the signal conductors are arranged.

8. The differential signal transmission cable according to claim 1, wherein the pair of shield conductors is devoid in the direction in which the signal conductors are arranged.

9. The differential signal transmission cable according to claim 1, wherein the insulator covers the peripheries of the signal conductors together.

10. The differential signal transmission cable according to claim 1, wherein each of the shield conductors is directly bonded to the insulator via an adhesive.

11. The differential signal transmission cable according to claim 1, wherein each of the shield conductors is bonded to the insulator.

12. The differential signal transmission cable according to claim 1, wherein a position corresponding to half of a width dimension of the shield conductor is located at the equidistant portion on the surface of the insulator.

13. The differential signal transmission cable according to claim 1, wherein the shield conductors are not provided in areas on the surface of the insulator located in a direction of arrangement of the signal conductors.

14. The differential signal transmission cable according to claim 1, wherein a same amount of an adhesive is applied to a same thickness to bonding surfaces of each of the shield conductors adjacent to the insulator so as to prevent electrical characteristics from being deteriorated by a difference in a thickness of the adhesive between each of the shield conductors.

15. The differential signal transmission cable according to claim 1, wherein a center point of each of the shield conductors is equidistant to a center point of the signal conductors.

16. A differential signal transmission cable comprising:

a pair of signal conductors;

an insulator disposed around each of the signal conductors; and a shield conductor provided in part of a surface of the insulator and disposed at an equidistant portion located in a direction orthogonal to a direction in which the signal conductors are arranged, the equidistant portion being equidistant from axial centers of the signal conductors, wherein the shield conductor includes a pair of shield conductors disposed opposite each other, with the insulator interposed therebetween, in the direction orthogonal to the direction in which the signal conductors are arranged, wherein each of the shield conductors is secured to the insulator, and wherein the insulator includes a first insulator disposed around the signal conductors and containing air bubbles, and a second insulator disposed around the first insulator and containing no air bubbles.

17. The differential signal transmission cable according to claim 16, wherein the pair of shield conductors has a width dimension greater than a distance between the axial centers of the signal conductors.

18. The differential signal transmission cable according to claim 17, wherein the pair of shield conductors is devoid in the direction in which the signal conductors are arranged.

19. The differential signal transmission cable according to claim 16, wherein the pair of shield conductors is devoid in the direction in which the signal conductors are arranged.

20. The differential signal transmission cable according to claim 16, wherein the insulator covers the peripheries of the signal conductors together.

* * * * *